US007250870B1

(12) United States Patent
Viner et al.

(10) Patent No.: US 7,250,870 B1
(45) Date of Patent: Jul. 31, 2007

(54) BACK DRAFT ALARM ASSEMBLY FOR COMBUSTION HEATING DEVICE

(76) Inventors: John Viner, 402 Lake St., Mt. Horeb, WI (US) 53572; Keith C. Williams, 7475 N. Lombardy Rd., Fox Point, WI (US) 53217

( * ) Notice: Subject to any disclaimer, the term of this patent is extended or adjusted under 35 U.S.C. 154(b) by 177 days.

(21) Appl. No.: 11/084,619

(22) Filed: Mar. 21, 2005

(51) Int. Cl.
*G08B 17/00* (2006.01)

(52) U.S. Cl. ..... 340/588; 340/514; 340/596; 340/691.5; 340/691.6; 340/693.1; 374/147; 431/13

(58) Field of Classification Search ..... 340/595, 340/596, 588, 514, 691.1, 691.4, 691.5, 691.6, 340/693.1, 693.2; 431/13; 137/551; 110/185, 110/190; 374/147–148
See application file for complete search history.

(56) References Cited

U.S. PATENT DOCUMENTS

| | | | | |
|---|---|---|---|---|
| 2,807,013 | A * | 9/1957 | Prough et al. | 340/590 |
| 4,389,124 | A * | 6/1983 | Longenecker | 374/147 |
| 4,406,396 | A * | 9/1983 | Habegger | 431/20 |
| 4,751,912 | A | 6/1988 | Monette | |
| 4,856,982 | A | 8/1989 | Olson | |
| 4,901,059 | A * | 2/1990 | Amann | 340/594 |
| 5,158,446 | A | 10/1992 | Hall | |
| 5,261,389 | A | 11/1993 | Trieb | |
| 5,280,802 | A | 1/1994 | Comuzie, Jr. | |
| 5,442,157 | A * | 8/1995 | Jackson | 340/589 |
| 5,479,350 | A * | 12/1995 | Barakchi et al. | 340/588 |
| 5,531,214 | A | 7/1996 | Cheek | |
| 5,797,358 | A | 8/1998 | Brandt et al. | |
| 6,044,853 | A | 4/2000 | Payzant | |
| 6,102,030 | A | 8/2000 | Brown et al. | |
| 6,450,874 | B2 | 9/2002 | Hoyez et al. | |
| 6,552,647 | B1 | 4/2003 | Thiessen et al. | |
| 6,715,451 | B2 | 4/2004 | Stretch et al. | |
| 6,726,111 | B2 | 4/2004 | Weimer et al. | |

* cited by examiner

*Primary Examiner*—Thomas Mullen
(74) *Attorney, Agent, or Firm*—Tipton L. Randall

(57) ABSTRACT

A back drafting alarm assembly is designed to detect back drafting in combustion fired appliances. The assembly includes a temperature sensor unit that is attached to the diverter bonnet of a water heater or furnace to measure the temperature at all times. The sensor is connected to an alarm assembly that sounds an alarm when the temperature of the bonnet reaches or exceeds 130 degrees F. for a predetermined time period. The preferred time period is three (3) minutes. The alarm assembly also includes a reset button to shut off the alarm and a test button to make certain that the device functions when installed. A microprocessor provides the additional capability to record the total number of excursion events over a longer monitoring period. The alarm operates on direct current from a battery, or standard 110 volts AC with a suitable AC/DC transformer. A battery backup feature provides uninterrupted power when using 110 volts AC as a power source. Back drafting is undesirable due to entry of carbon monoxide, produced by combustion, into the dwelling, resulting in dangerous or deadly conditions within the dwelling.

20 Claims, 6 Drawing Sheets

BACK DRAFT ALARM ASSEMBLY FOR COMBUSTION HEATING DEVICE

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a back draft alarm assembly for combustion heating devices and, more particularly, to a back draft alarm assembly requiring a specific duration for a back draft occurrence before emitting an alarm and, most particularly, to a back draft alarm assembly employing a plurality of temperature sensors proximate a flue gas opening of the heating device.

2. Background Information

Combustion heating devices are widely used in residential and commercial buildings for heating fluids for use by residents. The devices include water heaters and furnaces providing hot water and internal heating for the building residents. Natural gas and liquid propane (LP) are commonly used for fuel in both furnaces and water heaters, although oil, coal and biomass (wood) find use in furnaces. These combustion heating devices are nearly always located within the building, often in a lower or basement level. The combustion gases formed during burning of the fuel must be vented to the exterior of the building structure. The heating device is connected to a chimney or vent stack that extends to the structure exterior for this purpose. Although some furnaces include piping to draw air from exterior the structure for combustion, many furnaces and nearly all water heaters employ an atmospherically vented system. The hot gases are of lower density and thus rise up the vent stack heating the stack interior. The venting system includes an opening in the chimney or vent stack, adjacent the furnace or water heater, that draws some air from interior the structure along with the combustion gases to move the gases up the chimney or vent stack.

For various reasons, these atmospherically vented stacks do not function properly to remove combustion gases formed in the heating device. For example, the vent stack may be partially or completely plugged by solids, or the building structure may be so tightly sealed that little internal air is available to carry the combustion gases up the vent stack. The result is termed "back drafting," where combustion gases, including carbon monoxide, enter and remain within the building structure, causing a condition dangerous to the residents. Back drafting may be an intermittent problem for a combustion heating device and can be difficult to detect and monitor.

A number of patents concerned with the control and monitoring of various combustion heating devices have been granted.

Monette, in U.S. Pat. No. 4,751,912, describes a device for detecting the diversion of gas furnace or gas hot water heater exhaust into a dwelling due to chimney back drafting. The device detects a sustained rise in the temperature of the gases passing through the draft-diverter orifice. A significant rise in temperature indicates that the above condition has occurred. This temperature rise is recorded only after the condition has persisted for a sufficiently long period of time, thereby avoiding the recording of temporary back drafting conditions which are not required to be recorded. The device consists of a high temperature resistant plastic strip or other material with similar conductivity and specific heat qualities with a temperature sensitive color-change material mounted on the surface of the plastic strip at one end of the strip. This strip is attached to the furnace or gas hot water heater in a preferred location with the color-change material facing away from the normal flow of back drafting exhaust gases. Heat from the back drafting flow causes the color-change material to change color once the heat in the gas flow has penetrated through the underlying plastic strip. An aerodynamic stagnation zone on the front face of the plastic strip during a back draft condition prevents the color-change material from changing color prematurely.

In U.S. Pat. No. 4,856,982, Olson discloses an exhaust fan for exhausting combustion gases from a gas fired water heater, a gas pressure diaphragm switch for operating the exhaust fan in response to fuel flowing to the burner of the water heater, and a safety device for preventing fuel flow to the burner upon detecting undesirable changes in combustion gases. The apparatus further includes a time delay to continue operation of the exhaust fan and exhaust residual combustion gases for a short time after fuel flow to the burner has ceased. In one form, the time delay is a time delay relay switch and in another form it is a flow restricting orifice that restricts the flow of fuel from the gas pressure diaphragm switch, thereby maintaining a closed circuit to the exhaust fan.

Hall, in U.S. Pat. No. 5,158,446, describes a fuel-fired, forced draft heating appliance that includes a draft inducer fan having an inlet connected to a vent hood, an outlet connected to a vent pipe, and an interior housing region in which a negative pressure is generated during normal appliance operation. The vent hood receives hot combustion gases generated by the appliance, and has an inlet for receiving ambient dilution air that mixes with and cools the combustion gases entering the hood and subsequently is discharged into the vent pipe by the fan. A combination pressure and temperature limit control is used to sense the presence of an obstruction in either the vent pipe or the vent hood inlet and responsively shuts down the appliance. The control includes a vacuum switch external to the fan, a bimetallic disc-type temperature sensor disposed within the negative pressure fan region, and a conduit interconnecting the switch and the temperature sensor. During normal appliance operation, ambient air is drawn into the fan housing sequentially through the vacuum switch, the conduit and the temperature sensor. An obstruction in the vent pipe sufficient to reduce this air flow below a predetermined level causes the vacuum switch to responsively shut down the appliance. An undesirably high temperature within the fan, arising, for example, due to an obstruction in the vent hood inlet, causes the temperature sensor disc to block air flow through the conduit, thereby also causing the vacuum switch to responsively shut down the appliance.

In U.S. Pat. No. 5,261,389, Trieb discloses a power vent system for exhausting hot combustion gas by-products. The system includes a plenum or mixing chamber, a conduit system and an air aspirating discharge assembly. Negative pressure is developed in the plenum by a blower therein. Ambient air is drawn into the plenum from the atmosphere and mixed with the hot flue gases. The resulting cooled mixture is exhausted through the conduit system under pressure and, at the discharge assembly, additional ambient air is mixed with the mixture by a discharge assembly venturi effect, which also accelerates the gases away from the discharge assembly.

U.S. Pat. No. 5,280,802 by Comuzie, Jr., describes first and second sensors and alarm member mounted to a gas appliance. More particularly, the sensors are mounted to the diverter housing and adjacent a lower portion of the gas appliance for detection of spillage in the form of flue restriction relative to the first sensor. The second sensor provides roll-out sensing relative to gas fumes backed up in the flame portion of the gas appliance.

Cheek, in U.S. Pat. No. 5,531,214, describes a gas vent and burner monitoring system for monitoring a gas burner vent appliance. The system includes an alarm, a first sensor proximate the burner and a second sensor proximate the draft hood. Each sensor detects the occurrence of an event and the respective sensor activates the alarm when the event occurs. In a first embodiment, the sensors are temperature sensors. In an alternate embodiment, the temperature sensors are replaced with oxygen depletion sensors set to detect when the presence of oxygen is below a predetermined value. Further, the system may include a pressure sensor which trips the alarm when an increase in pressure in the pressurized chamber above normal operating levels is detected.

In U.S. Pat. No. 5,797,358, Brandt et al. disclose a multifunction controller for a water heater that includes a control panel and a plurality of sensors that monitor a variety of functions that impact the operation of a water heater. A flammable gas sensor, placed in proximity to the air intake, detects the presence of an unsafe concentration of gas and issues a signal to the control panel, which subsequently discontinues the operation of the burners. Detection of a blocked vent pipe is achieved by a carbon monoxide sensor placed near the draft hood. The control panel is equipped with circuitry which monitors usage of the heater for a specified time period to develop a pattern of use. Subsequent to the monitoring period, the controller will activate the burners a predetermined time prior to an anticipated period of high use. During periods of low use, the controller will decrease the temperature to which the water is to be heated, thereby resulting in a more efficient heater. Nonvolatile memory records data from the sensors are stored so that the operation status of the heater may be ascertained subsequent to a power outage. The control panel contains a plurality of visual alarms, each of which corresponds to a sensor. Consequently, repair and maintenance are simplified because the cause of a malfunction is quickly recognized.

Brown et al., in U.S. Pat. Nos. 6,044,835 and 6,102,030, describe a horizontal combined air intake and combustion gas vent terminal assembly having improved wind pressure response and anti-recirculation characteristics. The terminal has a vent conduit disposed inside an air intake conduit. A scoop assembly is provided at the intake conduit inlet to increase the intake air pressure at the inlet. The vent conduit is nozzle-like to throttle combustion gases, thereby accelerating the gases and permitting the terminal to project the gases away from the intake conduit terminal. The vent conduit is disposed asymmetrically with the intake conduit to further discourage mixing of intake air and combustion gases. The terminal may also be provided with a static pressure measuring means to provide an intrinsic safety shut down system within the terminal in case of a blockage of the intake or vent by snow, ice or other debris.

In U.S. Pat. No. 6,450,874, Hoyez et al. disclose a variable speed power flue ventilator with a thermostatically controlled motor cooling system. The thermostatically controlled cooling system employs an auxiliary motor cooling fan separate from the fan used by the power ventilator to extract exhaust gases. A thermostatic sensor switch actuates the motor cooling fan whenever the temperature in the exhaust fan motor housing rises to a preset value. The cooling fan then draws cool ambient air through the motor housing until the enclosed housing area reaches a second, lower, preset temperature at which point the cooling fan is shut off by the thermostat.

Thiessen et al., in U.S. Pat. No. 6,552,647, describe a monitor and control system that responds to alarm signals representing different hazardous conditions in an environment having a number of utility service supply lines, such as a home residence. One or more sensors coupled to the processor are each associated with one or more of the service supply lines. Each sensor produces an alarm signal in response to a hazardous condition attributable to an associated supply line. Each associated supply line is provided with a control device that is coupled to an output of the processor, and the processor is configured to produce one or more output signals in response to an alarm signal at a given input. Each control device is arranged to disable its associated supply line, with respect to a sensed hazardous condition, in response to a corresponding output signal from the processor.

In U.S. Pat. No. 6,715,451, Stretch et al. disclose a gas-fired water heater having a combustion chamber with a bottom wall defined by a perforated flame arrester plate forming a portion of a flow path through which combustion air may be supplied to a burner structure within the combustion chamber. During firing of the water heater, a combustion air shutoff system, having a heat-frangible temperature sensing structure disposed within the combustion chamber, senses an undesirable temperature increase in the combustion chamber. The temperature increase may be caused by a partial blockage of the flow path. The air shutoff system responsively terminates further air flow into the combustion chamber, thereby shutting down the burner, prior to the creation in the combustion chamber of a predetermined elevated concentration of carbon monoxide.

Weimer et al., in U.S. Pat. No. 6,726,111, describe a system and single controller for receiving constant and individualized information from a plurality of air control systems. A single controller is capable of controlling and interacting with at least two separate air control systems to control an environmental characteristic, and in the process, reduces the costs associated with the manufacturing and everyday operation of the individual systems. In addition, the controller is capable of intelligently communicating with the input and output devices of the system, and particularly with each individually interfaced appliance, such that the controller can adaptively control the system through the use of stored historical data.

Applicants have devised a back drafting alarm device that monitors and records each occurrence of a back draft condition for a combustion heating device over an extended period of time.

SUMMARY OF THE INVENTION

The invention is a back drafting alarm assembly designed to detect back drafting in combustion fired water heaters and similar devices. The assembly includes a temperature sensor unit that is attached to the diverter bonnet of a water heater or furnace to measure the temperature at all times. Preferably, the temperature sensor unit encircles the diverter bonnet to ensure correct temperature measurement. The temperature sensor unit is connected to an alarm assembly that sounds an alarm when the temperature of the bonnet reaches or exceeds 130 degrees F. for a predetermined time period. The preferred time period is three (3) minutes. The alarm assembly also includes a reset button to shut off the alarm and a test button to make certain that the device functions when installed. The time delay is achieved by a solid state electronic microprocessor, although a conventional relay element can be substituted for this function. In a further embodiment, the microprocessor provides the additional capability of recording the exact duration of the temperature excursion event, as well as the total number of excursion events occurring over a longer monitoring period. A suitable status indicator, such as a light emitting diode (LED) or liquid crystal display (LCD), is configured to provide such information. The alarm operates on direct current (DC) power provided by a 9-volt battery. Alternatively, a suitable transformer converts 110 volts alternating current (AC) to 9 volts DC, to operate the alarm assembly with equivalent performance. Back drafting is undesirable due to entry of carbon monoxide, produced by combustion, into the dwelling, resulting in dangerous or deadly conditions within the dwelling.

In a preferred embodiment of the invention, the alarm assembly includes an alarm member, with a temperature sensor unit positionable proximate the flue gas opening of the heating device. The temperature sensor unit is in electrical communication with the alarm member and activates the alarm member upon sensing an increase in temperature above a predetermined value. A time delay circuit is interposed between the temperature sensor unit and the alarm member, providing a delay of predetermined duration between the temperature sensor unit sensing an increase in temperature above the predetermined value and activation of the alarm member. A light emitting diode, or liquid crystal display, is in electrical communication with the alarm member, the diode or display being lit upon powering of the alarm assembly. A reset switch is in electrical communication with the alarm member and the switch deactivates the alarm member and resets the time delay circuit. A test button is present for momentarily activating the alarm member, and a power source is present for providing electrical power to the alarm assembly.

DESCRIPTION OF THE EMBODIMENTS

Nomenclature

| | |
|---|---|
| 10 | Back Draft Alarm Assembly |
| 15 | Housing of Assembly |
| 20 | Temperature Sensor Unit |
| 22 | Temperature Sensing Members |
| 23 | Flexible Cable Member |
| 25 | Power Wire Conductor |
| 30 | Battery |
| 35 | Alarm Member |
| 40 | Time Delay Circuit |
| 45 | Light Emitting Diode Member |
| 50 | Reset Switch Member |
| 55 | Test Button Member |
| 60 | Recording Circuit |
| 65 | Recording Circuit Readout |
| 70 | AC/DC Transformer |
| 80 | Chirper Battery Alarm |
| B | Flue Gas Opening |
| C | Combustion Heating Device |
| D | Deflector Bonnet |

Construction

The invention is an alarm assembly adapted for sensing and recording a back drafting event proximate a flue gas opening in an atmospherically vented, combustion heating device. The assembly comprises an alarm member with a temperature sensor unit positioned proximate the flue gas opening of the heating device. The temperature sensor unit is in electrical communication with the alarm member and activates the alarm member, upon sensing an increase in temperature above a predetermined value. A time delay circuit is interposed between the temperature sensor unit and the alarm member providing a delay of predetermined duration between the temperature sensor unit sensing an increase in temperature above the predetermined value and activation of the alarm member. A light emitting diode, or liquid crystal display, is in electrical communication with the alarm member, the diode or display being lit upon powering of the alarm assembly. A reset switch is in electrical communication with the alarm member, and the switch deactivates the alarm member and resets the time delay circuit upon activation. A test button is present for momentarily activating the alarm member, and a power source is present for providing electrical power to the alarm assembly.

Figure 1:
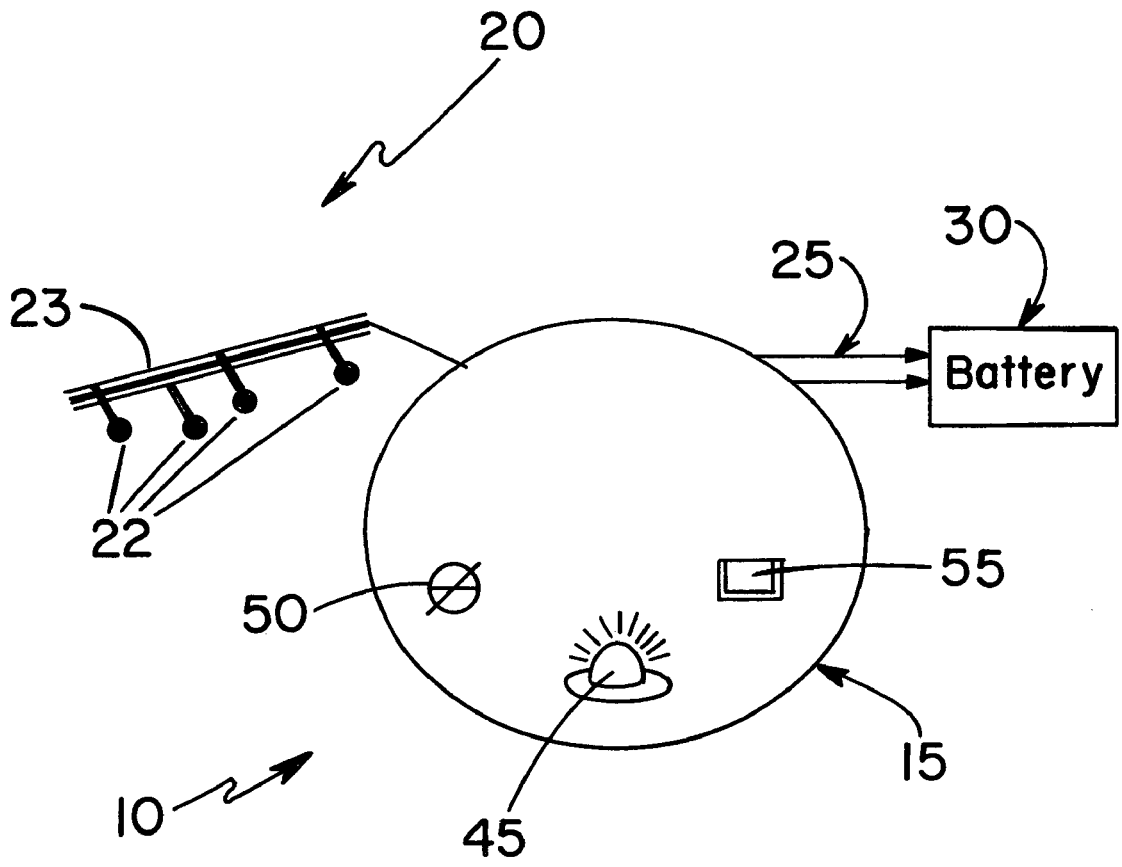
FIG. 1 is a perspective view of one embodiment of the back draft alarm assembly of the present invention.

Referring now to FIG. 1, one embodiment of the alarm assembly 10 of the present invention is shown. The alarm assembly 10 is employed for sensing and recording a back drafting event proximate a flue gas opening B in an atmospherically vented, combustion heating device C. The alarm assembly 10 includes a housing 15 for the components of the assembly 10, with a temperature sensor unit 20 positioned external the housing 15 and a power wire 25 and battery 30, preferably contained within the housing 15 to provide electrical power to the assembly 10. Alternatively, a suitable AC/DC transformer 70 can convert 110 volts AC to 9 volts DC, to operate the alarm assembly 10 with equivalent performance.

Figure 3:
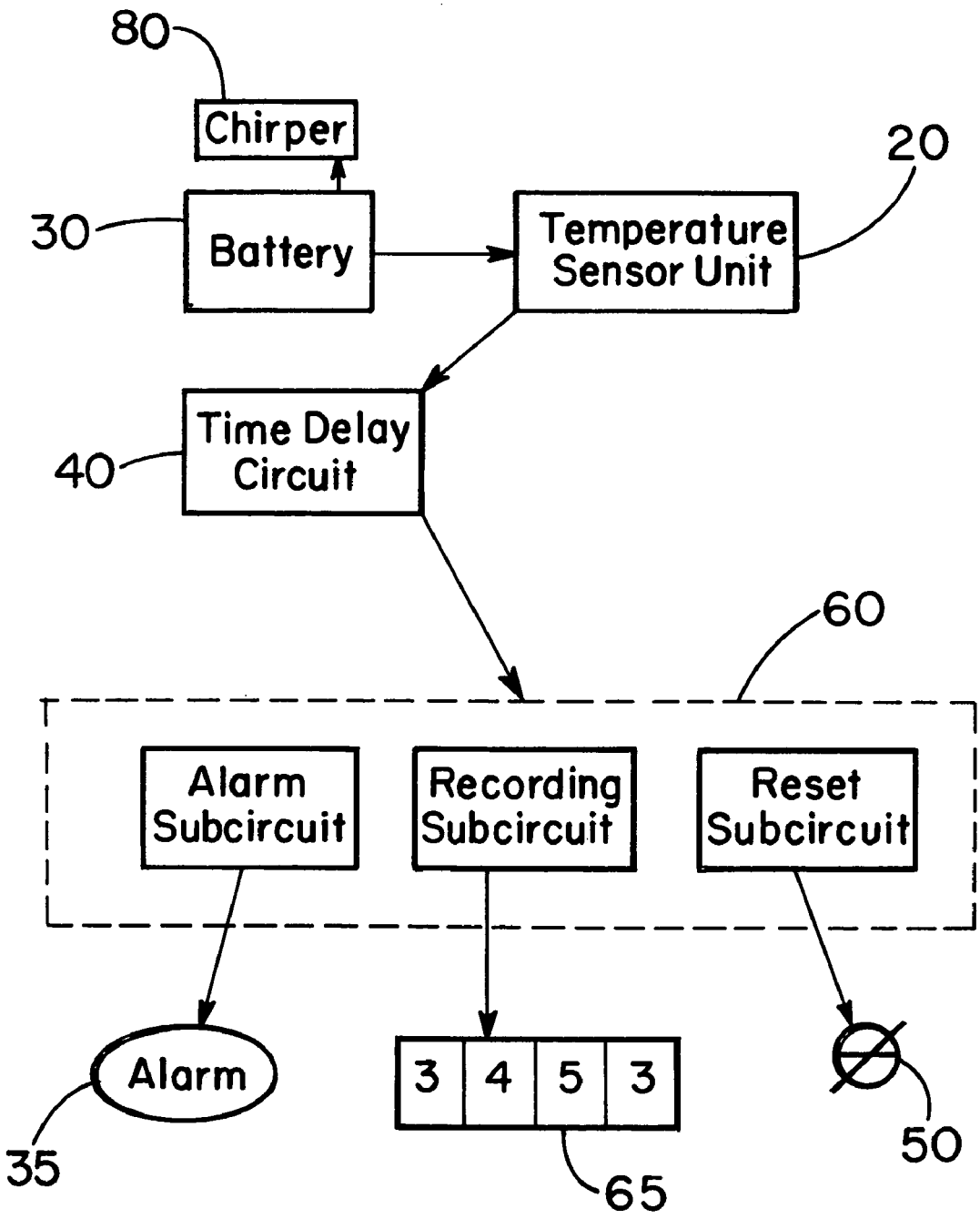
FIG. 3 is a schematic representation of one embodiment of the back draft alarm assembly of the present invention.
Figure 4:
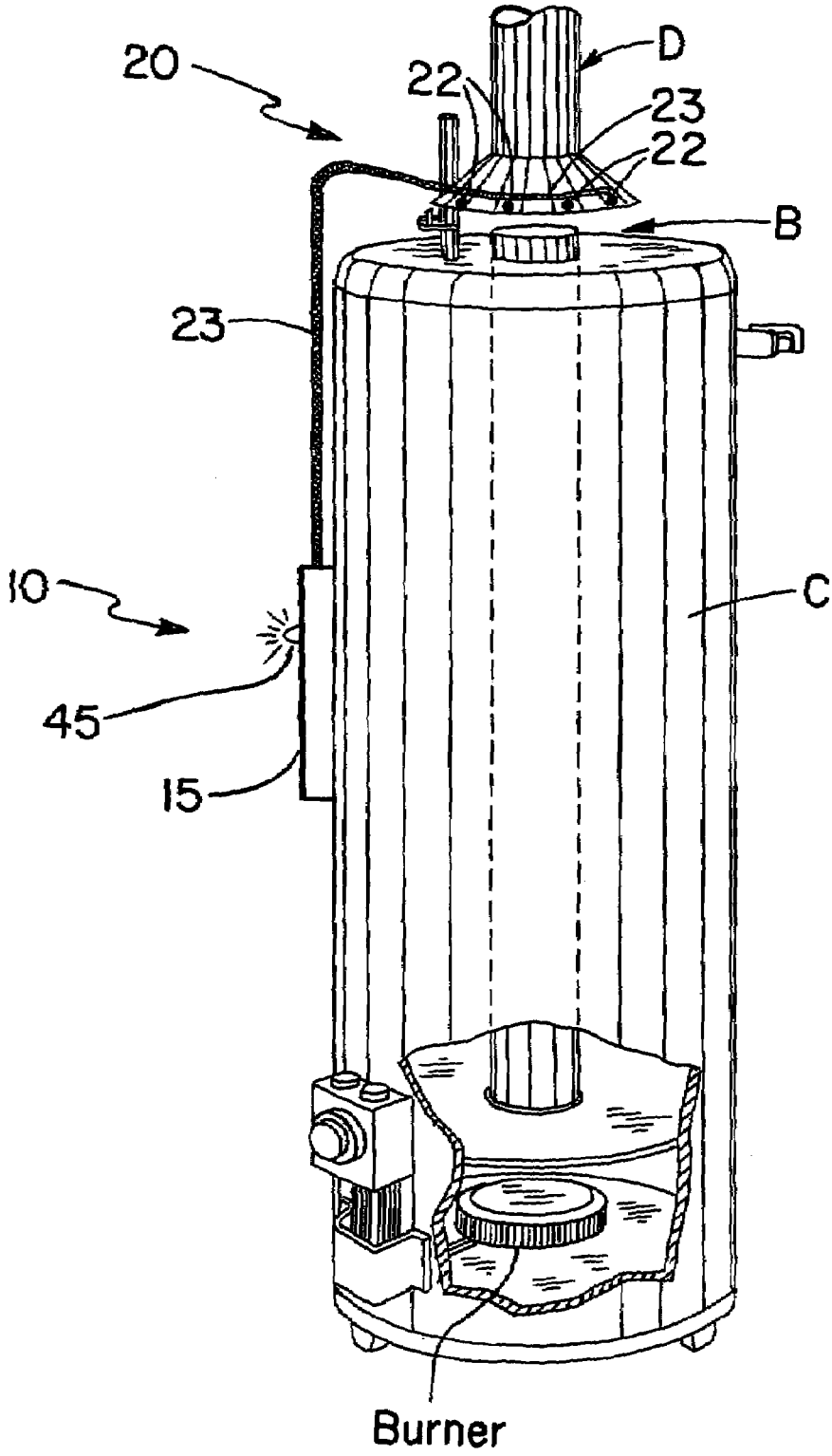
FIG. 4 is a perspective view of a combustion fired water heater fitted with the back draft alarm assembly of the present invention mounted thereto.
Figure 5:
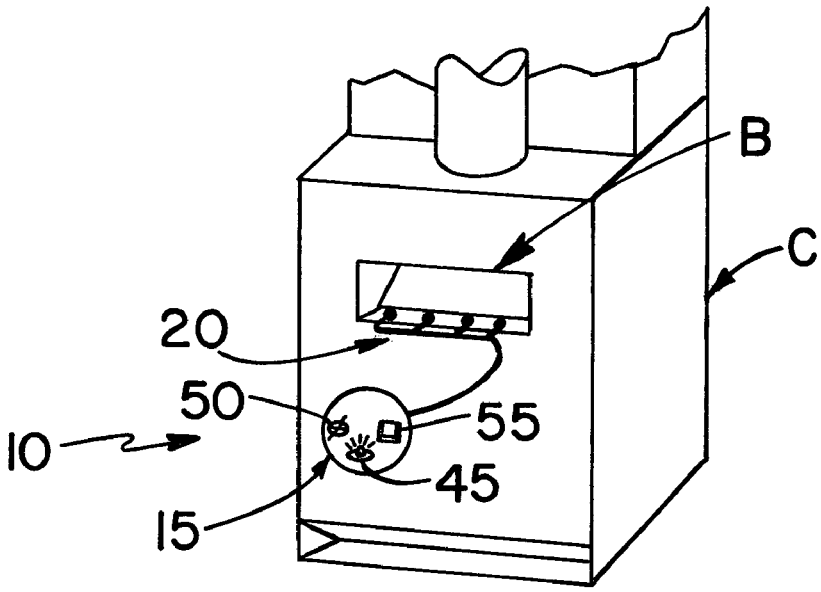
FIG. 5 is a perspective view of a combustion fired furnace fitted with the back draft alarm assembly of the present invention mounted thereto.
Figure 6:
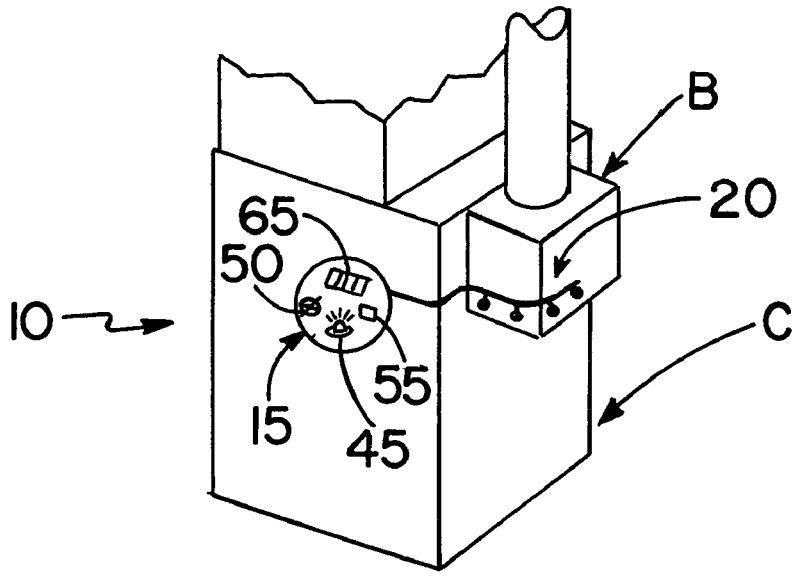
FIG. 6 is a perspective view of another combustion fired furnace fitted with the back draft alarm assembly of the present invention mounted thereto.

The alarm assembly components contained within the housing 15 include an alarm member 35 (FIGS. 3 and 7) that provides an audio alarm and/or a visual alarm upon activation. The temperature sensor unit 20 extends from the housing 15 and is positioned proximate the flue gas opening B of the heating device C. The temperature sensor unit 20 is in electrical communication with the alarm member 35 and activates the alarm member 35 upon sensing an increase in temperature above a predetermined value. Preferably, the temperature sensor unit 20 includes a plurality of temperature sensing members 22, such as thermistors, operatively functioning with a flexible cable 23 for attachment proximate a flue gas opening B of the combustion heating device C. The flexible cable 23 allows the temperature sensing members 22 to be mounted encircling the flue gas opening B of the combustion heating device C, as illustrated in FIG. 4, or to be positioned in a linear configuration for certain furnace devices, as illustrated in FIGS. 5–6. The flexible cable 23 of the temperature sensor unit 20 is fabricated from a heat-resistant material to withstand temperatures up to about 500 degrees F. Mechanical fasteners (not shown) may be provided for securing the flexible cable 23 and temperature sensing members 22 to the heating device C proximate the flue gas opening B.

A time delay circuit 40 (FIGS. 3 and 7) is interposed between the temperature sensor unit 20 and the alarm member 35. The circuit 40 provides a delay of predetermined duration between the temperature sensor unit 20 sensing an increase in temperature above the predetermined value, and activation of the alarm member 35.

A light emitting diode 45 is in electrical communication with the alarm member 35 and mounted on the outer surface of the housing 15. The diode 45 is lit upon powering of the alarm assembly 10 to provide assurance that the assembly 10 is receiving power from a power source, in this case, the battery 30. Optionally, the diode 45 may be interconnected to the alarm member 35 to provide a flashing output, in addition to an audio output provided by the alarm member 35. The housing 15 also includes a reset switch member 50 in electrical communication with the alarm member 35. The reset switch member 50 deactivates the alarm member 35 and resets the time delay circuit 40. A test button 55 is positioned on the housing 15 for momentarily activating the alarm member 35 to ensure the alarm assembly 10 is functioning properly upon installation of the alarm assembly 10 on a combustion heating device C.

Figure 2:
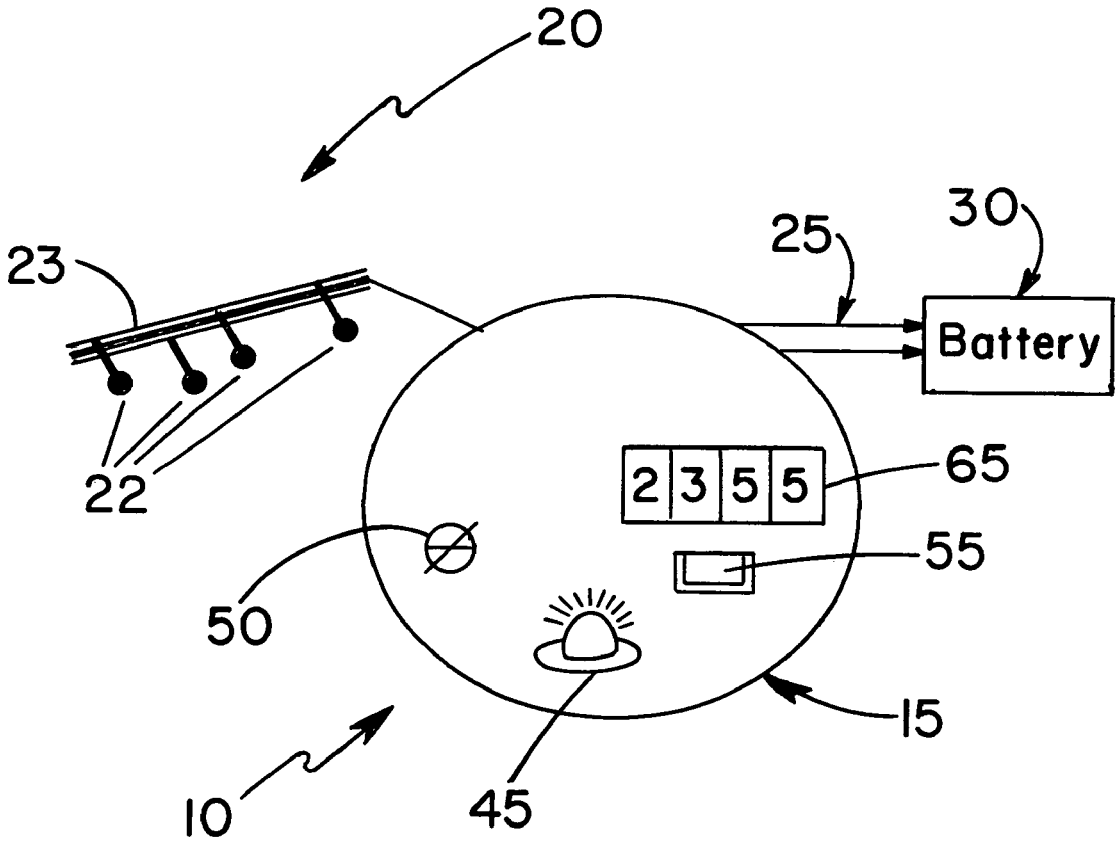
FIG. 2 is a perspective view of a further embodiment of the back draft alarm assembly of the present invention.
Figure 7:
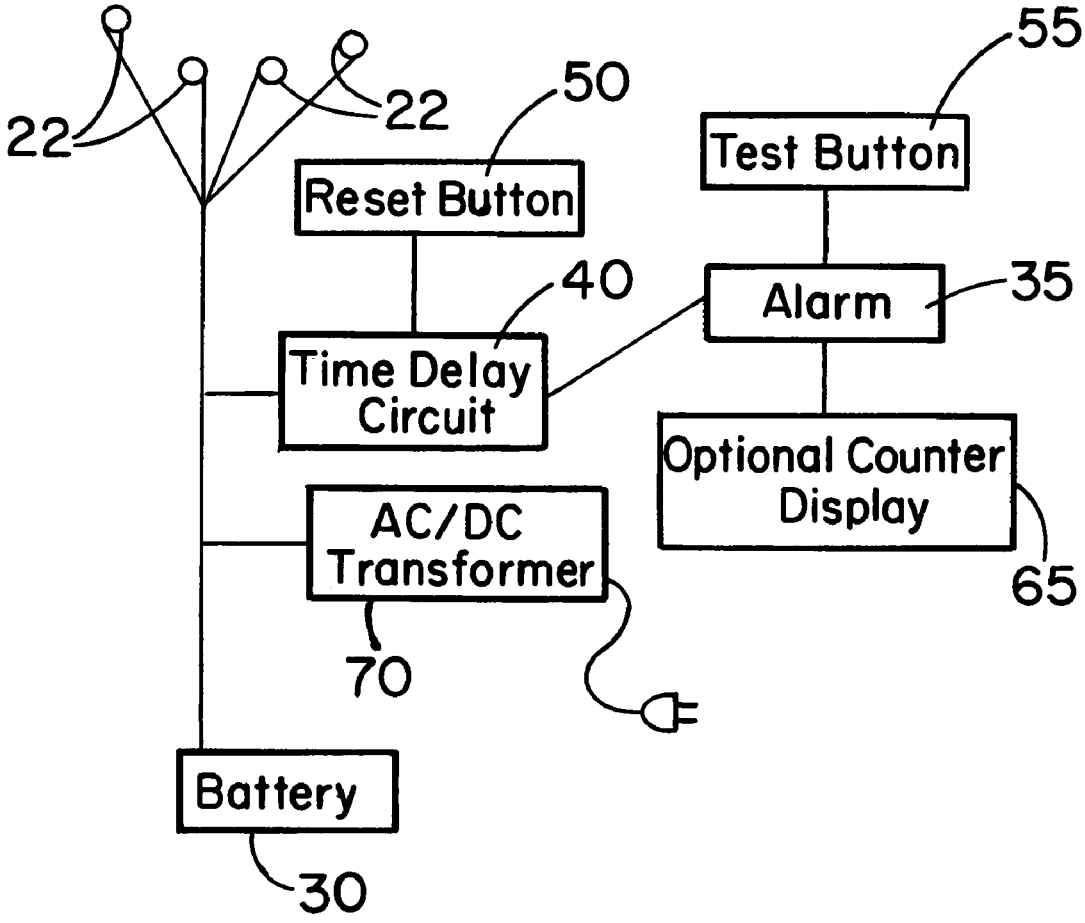
FIG. 7 is another schematic representation of one embodiment of the back draft alarm assembly of the present invention.

In a further embodiment of the invention, a recording circuit 60 is in electrical communication with the alarm member 35. The recording circuit 60 produces a record of each alarm activation over a monitoring time period of predetermined duration. The recording circuit 60 also provides a readout 65 of the total number of times the alarm member 35 is activated. For example, a numerical readout 65, or similar device, is provided for displaying this information, as illustrated in FIGS. 2, 3 and 7. The alarm assembly 10 includes a digital circuit operating the alarm member 35, and the reset switch 50. In yet a further embodiment, the digital circuit includes a recording circuit 60 for producing a record of the duration of each alarm activation.

The alarm assembly 10 operates from a power source 30 of 9 volts direct current that provides electrical power to the alarm assembly 10. A standard 9-volt battery is preferred. Additionally, the alarm assembly 10 includes a chirper device 80, well known in the industry, which activates when the battery power source 30 falls below a predetermined power level.

In an alternative embodiment of the invention, a transformer 70 receives 110 volt alternating current and supplies 9 volts direct current to power the alarm assembly 10. The assembly 10 then includes a battery backup power source 30 for powering the alarm assembly 10 should the 110 volts alternating current source supplying the transformer 70 be interrupted.

The alarm assembly 10 is shown installed on a combustion fired water heater appliance C in FIG. 4. The flexible cable member 23 containing the plurality of temperature sensing members 22 is mounted proximate the flue gas opening B of the water heater C. In this case, the flexible cable member 22 is mounted to the deflector bonnet D of the water heater C.

Referring now to FIGS. 5 and 6, the alarm assembly 10 is shown installed on several types of combustion fired furnaces C. In each of these figures, the flexible cable member 23 containing the plurality of temperature sensing members 22 is mounted proximate the flue gas opening B of each furnace C. Although the housing 15 of the alarm assembly 10 is illustrated as mounted directly on the combustion fired heating device C, the housing 15 can be mounted remotely from the device C by using a flexible cable member 22 of extended length.

While the invention has been particularly shown and described with reference to preferred embodiments thereof, it will be understood by those skilled in the art that various changes in form and details may be made therein without departing from the spirit and scope of the invention.

We claim:

1. An alarm assembly adapted for sensing and recording a back drafting event proximate a flue gas opening in an atmospherically vented, combustion heating device, the alarm assembly comprising:

an alarm member;

a temperature sensor unit adapted for positioning proximate the flue gas opening of the heating device, the temperature sensor unit in electrical communication with the alarm member and activating the alarm member upon sensing an increase in temperature above a predetermined value;

a time delay circuit interposed between the temperature sensor unit and the alarm member providing a delay of predetermined duration between the temperature sensor unit sensing an increase in temperature above the predetermined value and activation of the alarm member;

a light emitting diode in electrical communication with the alarm member, the diode being lit upon powering of the alarm assembly;

a reset switch in electrical communication with the alarm member, the reset switch deactivating the alarm member and resetting the time delay circuit;

a test button for momentarily activating the alarm member; and a power source for providing electrical power to the alarm assembly.

2. The alarm assembly adapted for sensing and recording a back drafting event proximate a flue gas opening in an atmospherically vented, combustion heating device of claim 1, further including a recording circuit in electrical communication with the alarm member, the recording circuit producing a record of each alarm activation over a monitoring time period of predetermined duration.

3. The alarm assembly adapted for sensing and recording a back drafting event proximate a flue gas opening in an atmospherically vented, combustion heating device of claim 2, wherein the recording circuit produces a numerical readout of each alarm activation over a monitoring time period of predetermined duration.

4. The alarm assembly adapted for sensing and recording a back drafting event proximate a flue gas opening in an atmospherically vented, combustion heating device of claim 1, wherein the alarm member produces an audio alarm upon activation.

5. The alarm assembly adapted for sensing and recording a back drafting event proximate a flue gas opening in an atmospherically vented, combustion heating device of claim 1, wherein the alarm member produces an audio alarm and a visual alarm upon activation.

6. The alarm assembly adapted for sensing and recording a back drafting event proximate a flue gas opening in an atmospherically vented, combustion heating device of claim 1, wherein the temperature sensor unit includes a plurality of temperature sensing members.

7. The alarm assembly adapted for sensing and recording a back drafting event proximate a flue gas opening in an atmospherically vented, combustion heating device of claim 6, wherein the temperature sensing members are mounted to a flexible cable adapted for being attached proximate a flue gas opening of the combustion heating device.

8. The alarm assembly adapted for sensing and recording a back drafting event proximate a flue gas opening in an atmospherically vented, combustion heating device of claim 1, wherein the predetermined temperature value is about one hundred thirty (130) degrees F. and the time delay of predetermined duration is about three (3) minutes.

9. The alarm assembly adapted for sensing and recording a back drafting event proximate a flue gas opening in an atmospherically vented, combustion heating device of claim 1, wherein the power source for the alarm assembly includes a battery member providing 9 volts direct current.

10. The alarm assembly adapted for sensing and recording a back drafting event proximate a flue gas opening in an atmospherically vented, combustion heating device of claim 1, wherein the power source for the alarm assembly includes an AC/DC transformer providing 9 volts direct current for powering the alarm assembly.

11. The alarm assembly adapted for sensing and recording a back drafting event proximate a flue gas opening in an atmospherically vented, combustion heating device of claim 1, wherein the alarm assembly includes a digital circuit operating the alarm member, the reset switch and the recording circuit for producing a record of each alarm activation.

12. An alarm assembly adapted for sensing and recording a back drafting event proximate a flue gas opening in an atmospherically vented, combustion heating device, the alarm assembly comprising:

an alarm member;

a temperature sensor unit adapted for positioning proximate the flue gas opening of the heating device, the temperature sensor unit in electrical communication with the alarm member and activating the alarm member upon sensing an increase in temperature above a predetermined value;

a time delay circuit interposed between the temperature sensor unit and the alarm member providing a delay of predetermined duration between the temperature sensor unit sensing an increase in temperature above the predetermined value and activation of the alarm member;

a light emitting diode in electrical communication with the alarm member, the diode being lit upon powering of the alarm assembly;

a reset switch in electrical communication with the alarm member, the reset switch deactivating the alarm member and resetting the time delay circuit;

a test button for momentarily activating the alarm member;

a recording circuit in electrical communication with the alarm member, the recording circuit producing a record of each alarm activation over a monitoring time period of predetermined duration; and a battery member providing 9 volts direct current electrical power to the alarm assembly.

13. The alarm assembly adapted for sensing and recording a back drafting event proximate a flue gas opening in an atmospherically vented, combustion heating device of claim 12, wherein the recording circuit produces a numerical readout of each alarm activation over a monitoring time period of predetermined duration.

14. The alarm assembly adapted for sensing and recording a back drafting event proximate a flue gas opening in an atmospherically vented, combustion heating device of claim 12, wherein the alarm member produces an audio alarm upon activation.

15. The alarm assembly adapted for sensing and recording a back drafting event proximate a flue gas opening in an atmospherically vented, combustion heating device of claim 12, wherein the alarm member produces an audio alarm and a visual alarm upon activation.

16. The alarm assembly adapted for sensing and recording a back drafting event proximate a flue gas opening in an atmospherically vented, combustion heating device of claim 12, wherein the temperature sensor unit includes a plurality of temperature sensing members.

17. The alarm assembly adapted for sensing and recording a back drafting event proximate a flue gas opening in an atmospherically vented, combustion heating device of claim 16, wherein the temperature sensing members are mounted to a heat resistant, flexible cable adapted for being attached proximate a flue gas opening of the combustion heating device.

18. The alarm assembly adapted for sensing and recording a back drafting event proximate a flue gas opening in an atmospherically vented, combustion heating device of claim 12, wherein the predetermined temperature value is about one hundred thirty (130) degrees F. and the time delay of predetermined duration is about three (3) minutes.

19. The alarm assembly adapted for sensing and recording a back drafting event proximate a flue gas opening in an atmospherically vented, combustion heating device of claim 12, wherein the alarm assembly includes a digital circuit operating the alarm member, the reset switch and the recording circuit for producing a record of each alarm activation.

20. An alarm assembly adapted for sensing and recording a back drafting event proximate a flue gas opening in an atmospherically vented, combustion heating device, the alarm assembly comprising:

an audio alarm member;

a temperature sensor unit adapted for positioning proximate the flue gas opening of the heating device, the temperature sensor unit in electrical communication with the alarm member and activating the alarm member upon sensing an increase in temperature above a predetermined value, the temperature sensor unit including a plurality of temperature sensing members mounted to a flexible cable for attachment proximate a flue gas opening of the combustion heating device;

a time delay circuit interposed between the temperature sensor unit and the alarm member providing a delay of predetermined duration between the temperature sensor unit sensing an increase in temperature above the predetermined value and activation of the alarm member;

a light emitting diode in electrical communication with the alarm member, the diode being lit upon powering of the alarm assembly;

a reset switch in electrical communication with the alarm member, the reset switch deactivating the alarm member and resetting the circuit;

a test button for momentarily activating the alarm member;

a recording circuit in electrical communication with the alarm member, the recording circuit producing a record of each alarm activation over a monitoring time period of predetermined duration;

a digital circuit operating the alarm member, the reset switch and the recording circuit for producing a record of each alarm activation; and a battery member providing 9 volts direct current electrical power to the alarm assembly.

* * * * *